United States Patent [19]

Ide

[11] 4,054,182

[45] Oct. 18, 1977

[54] LADDER CARRIAGE

[76] Inventor: Allan R. Ide, 10066 Bloomfield, Cypress, Calif. 90630

[21] Appl. No.: 704,534

[22] Filed: July 12, 1976

[51] Int. Cl.[2] ..... E06C 5/04

[52] U.S. Cl. ..... 182/68; 182/127

[58] Field of Search ..... 182/63, 127, 68, 150, 182/36

[56] References Cited

U.S. PATENT DOCUMENTS

| | | | |
|---|---|---|---|
| 2,601,092 | 6/1952 | Cardiff | 182/63 |
| 3,456,756 | 7/1969 | Price | 182/63 |
| 3,608,669 | 9/1971 | Lindsay | 182/63 |
| 3,621,935 | 11/1971 | Bode | 182/68 |

*Primary Examiner*—Reinaldo P. Machado

*Attorney, Agent, or Firm*—Fulwider, Patton, Rieber, Lee & Utecht

[57] ABSTRACT

There is disclosed a ladder carriage including a truck carried on wheels and formed with a cantilever projection for overhanging the side of a dock and pivotally mounting at its extremity a ladder slide which is rotatable between a vertical operative position and a horizontally disposed storing position. A rigid ladder is slidably carried in such slide and extension and retraction thereof is controlled by an extension control winch connected between such ladder and the truck for extending the ladder downwardly into a barge moored alongside such dock. Further, a retraction worm gear is connected with the slider to pivot it between its horizontally disposed storage position and vertically disposed operative position.

6 Claims, 4 Drawing Figures

LADDER CARRIAGE

BACKGROUND OF THE INVENTION

1. Field of the Invention

The present invention relates to a ladder which may be utilized in obtaining access to a barge floating adjacent a dock.

2. Description of the Prior Art

In the transportation of cargo by sea, it is of utmost importance that the time during which a freight vessel is tied up in the harbor for loading and unloading, frequently referred to as "down time", minimized since the daily charter fare for such vessel frequently continues on irrespective of the number of days in port. In effort to minimize such down time, a barge system has been introduced known as "lash-barges" wherein barges are loaded from the dock in the inner harbor and once the loading of an entire set of such lash-barges has been completed, the seagoing vessel is brought into the harbor and such barges quickly loaded thereonto for transportation to a port where such barges may then be unloaded from the seagoing vessel.

Since longshoremen must frequently board such barges from the docks to which they are moored, it is important, from a safety standpoint that a convenient and nonhazardous means be provided for boarding such barges from the dock and that such means be mobile for repositioning depending on the location on the dock at which the barge is moored and that the means be adjustable for accommodating different levels for the barges depending on the level of the tide. Trucks have previously been proposed for wheeling a ladder about a dock and then lowering such ladder by means of a winch to board a boat, but such devices have failed to gain general acceptance. A ladder device of this type is shown in U.S. Pat. No. 1,067,002. Since the ladder itself may have a length in excess of 20 feet, it is impractical to store the ladder in its vertical retracted position.

SUMMARY OF THE INVENTION

The ladder carriage of the present invention is characterized by a ladder slide carried pivotally from a truck supported on a dock and slidably receiving a ladder and arranged in such a maner that the slider may be disposed vertically for lowering of the ladder into a barge and after serving its purpose for such barge the ladder may be retracted vertically and the slider pivoted to a horizonal position to store the ladder disposed horizontally on the truck.

DESCRIPTION OF THE PREFERRED EMBODIMENT

Figure 1:
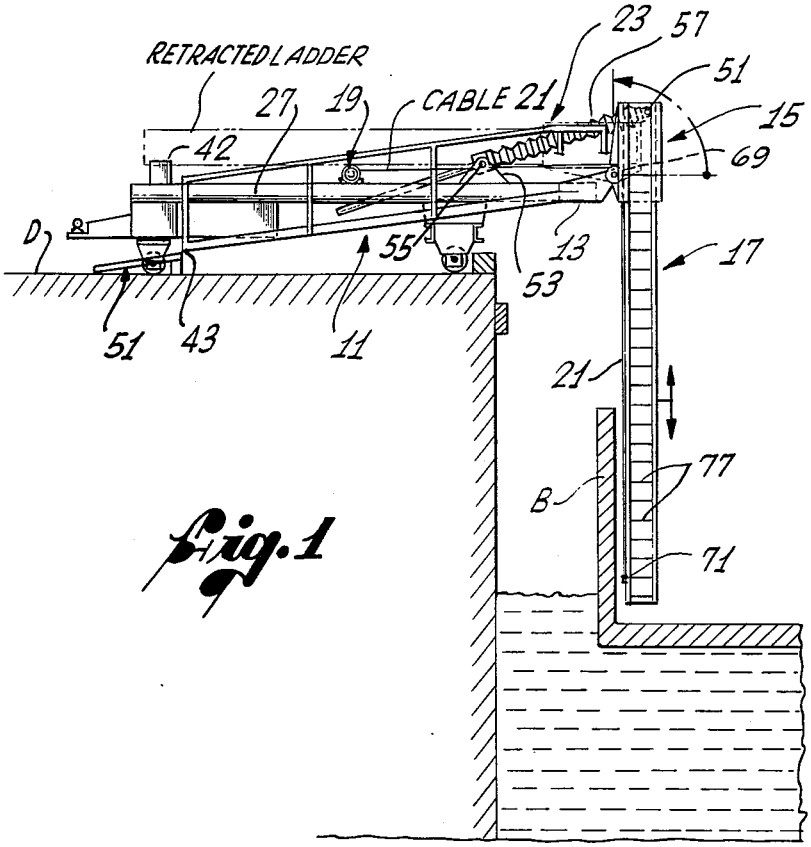
FIG. 1 is a side elevational view of a ladder carriage embodying the present invention.
Figure 4:
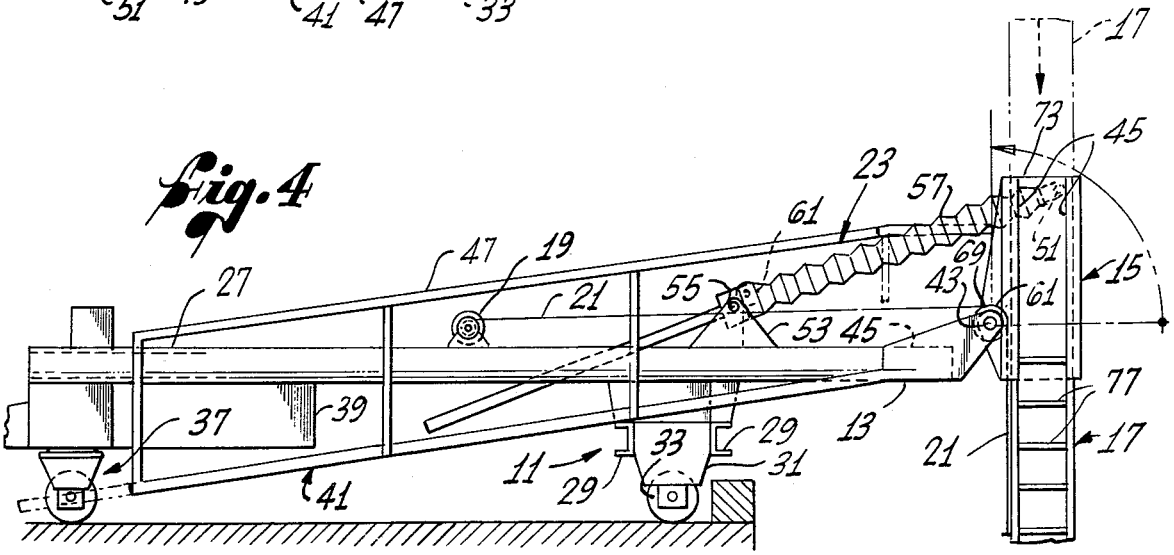
FIG. 4 is a partial side elevational view, in enlarged scale, of the ladder carriage shown in FIG. 1.

Referring to FIGS. 1 and 4, the ladder carriage device of the present invention includes, generally, a truck 11 formed with a cantilever projection 13, to which is pivotally mounted a slide 15 slidably receiving a rigid ladder 17. A suspension winch, generally designated 19, has the end of its cable 21 connected with the lower end of the ladder 17 for shifting such ladder between its lowered operative position and its raised inoperative position. A worm screw assembly, generally designated 23, is connected between the truck 11 and one end of the slide 15 for pivoting such slide between its solid line vertically extended position shown in FIG. 1 and its horizontally retracted position shown in broken lines in FIG. 1. Thus, the truck 11 may be wheeled into position on a dock D to cause the slide 15 to overhang a barge B moored adjacent such dock, the slide 15 pivoted to its vertical position and the ladder 17 lowered vertically downwardly into the barge for access thereto. When the barge has been unloaded, the ladder may be raised upwardly and the slide 15 pivoted to its horizontal position storing the ladder in the broken line position shown in FIG. 1.

Figure 3:
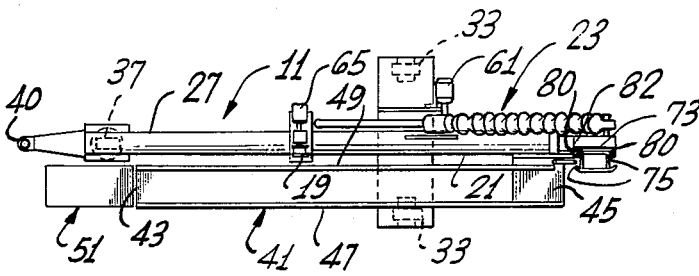
FIG. 3 is a top plan view of the ladder carriage shown in FIG. 1.

Referring to FIGS. 3 and 4, the truck 11 is formed by a longitudinal tubular frame 27 supported centrally by means of a pair of cross beams 29 (FIG. 4) mounted on end flanges 31 which are in turn mounted from wheels 33. The rear extremity of the truck 11 is supported on a wheel assembly, generally designated 37, and such rear extremity is counterweighted by means of a counterweight 39 supported beneath the tube 27 to thus provide counterbalance for the cantilever projection 13 and ladder 17 when it is in its operative position shown in solid lines in FIG. 1. A tow bar 40 is provided at the back end of such truck for towing thereof into position. A receiver is mounted on top of the rear of the truck 11 and is formed with an upwardly opening bracket 42 for nesting therein of the top of the ladder 17 when it is in its retracted horizontal position as shown in broken lines in FIG. 1.

Mounted on one side of the truck 11 is a ramp, generally designated 41 (FIG. 3) which slopes upwardly from its slightly elevated rear end 43 disposed adjacent the rear wheel assembly 37 toward the projection 13 to bend at its forward extremity and extend horizontally to form a landing 45 adjacent the ladder 17, thus providing a platform for the longsoremen to stand on when they mount and dismount such ladder. Hand railings 47 and 49 are provided on opposite sides of such walkway 41 for grasping while walking therealong. A wedge-shaped removable portable ramp, generally designated 51, is provided for positioning adjacent the lower rear end 43 of the walkway 41 and angles downwardly to the dock D to thereby provide a continuous incline therealong and along such walkway.

Referring to FIG. 4, the slide 15 is formed of flat sheet metal carried at one side from a pivot pin 43 and is formed along its opposite sides with C-shaped retaining flanges 45 which hold the opposite sides of the ladder 17 captive for telescopical sliding therethrough. The screw of the worm gear assembly 23 is connected with the upper extremity of the ladder 15 by means of a pivot pin 51 and the worm gear itself (not shown) is carried from a mounting bracket 53 by means of a pivot pin 55. The length of worm screw from the pivot pin 55 to the pivot pin 51 is covered by means of a protective accordian jacket 57. Referring to FIG. 3, the worm gear is driven by means of a retraction drive motor 61 mounted centrally on the truck 11.

Referring to FIGS. 3 and 4, the retraction winch 19 is driven by means of a drive motor 65 and the wire rope 21 extending therefrom threads over a pulley 69 (FIG. 1) and extends downwardly to connect at its lower extremity with an anchor fitting 71 anchoring such extremity to the bottom end of the ladder 17.

Figure 2:
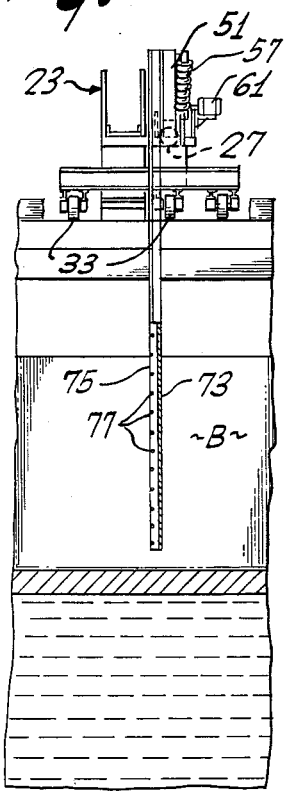
FIG. 2 is a righthand end view of the ladder carriage shown in FIG. 1.

Referring to FIGS. 2 and 3, the ladder itself is formed with a longitudinal back wall having opposite side walls 75 projecting therefrom to form a box-like structure. Mounted from the walls 75 at the open side of such box-like structure are vertically spaced apart ladder rungs 77 and projecting laterally from the back sides of such structure are parallel runners 80 received in tracks 82 to provide for sliding therepast of such ladder 17.

Referring to FIG. 1, in operation a barge B to be unloaded is maneuvered adjacent a dock D by means of tugboats or the like and then moored in position. A tractor (not shown) is then connected with the tow bar 40 and the truck 11 maneuvered into position with the projection 13 overhanging the edge of the dock D to be positioned in alignment over the barge B. The retraction motor 61 is then actuated to drive the worm screw gear assembly 23 to raise the ladder slide 15 from its horizontal position to its vertically extending position with the ladder 17 being maintained in its fully retracted and elevated position.

Once the slide 15 is in vertical alignement over the barge B, the extension motor 65 (FIG. 3) is actuated to drive the winch 19 to feed out the wire rope 21 thus lowering the ladder 17 to project the lower extremity thereof into the barge B. Such lowering of the ladder is continued until the desired level is reached for the lower extremity thereof, such level depending on the level of the tide and elevation of the barge deck relative to the water surface.

The portable ramp 51 (FIG. 3) may then be shifted into position adjacent the rear extremity of the truck ramp 41 and the longshoreman can then ascend the portable ramp 51 to gain access to the main ramp 41. Such lonshoreman may walk outwardly on such ramp 41 to the landing 45, the weight of the longshoreman being counterbalanced by the counterweight 39. The longshoreman may then step onto the ladder 17 and such ladder will be supported under the weight of such longshoreman by means of the cable 21. The longshoreman may then work his way down the ladder 17 to the barge and the same procedure may then be followed by other longshoremen assigned to the particular barge.

Should the tide raise while the barge B is moored, the bottom of the ladder 17 will be engaged by the bottom deck of such barge and is free to raise upwardly relative to the ladder slide 15.

When the longshormene subsequently elect to go ashore, as for instance when the barge B has been fully unloaded, they may ascend up the ladder 17 and step onto the landing 45 to walk down the ramps 41 and 51 to the dock level.

When it is desirable to store the ladder device of present invention the ladder 17 may be retracted by actuating the extension drive motor 65 to wind the wire rope 21 up on the winch 19, thus raising the ladder 17 in the slide 15. The slide 15 may then be retracted by actuating the retraction motor 61 to drive the worm screw assembly 23 to rotate the ladder slide 15 counterclockwise as viewed in FIGS. 1 and 4, to retract it to its horizontal broke line position shown in FIG. 1.

A tractor may then be hooked onto the tow bar 40 and the truck 11 towed to its storage area or to another location on the dock for use in loading or unloading another barge B.

From the foregoing it will be apparent that the ladder carriage device of the present invention provides an economical, convenient and safe means for boarding a barge or other vessel moored adjacent a dock and is, itself, relatively convenient to use and store.

Various modifications and changes may be made with regard to the foregoing detailed description without departing from the spirit of the invention.

I claim:

1. A barge access ladder carriage apparatus to facilitate access by workmen to a barge moored alongside and beneath the level of a dock and comprising:

truck means including an overhang projecting from one end thereof;

a ladder slide pivotally carried from said truck overhang for rotation between a vertical operative position and a horizontally disposed stowing position;

a ladder slidably carried from said slide for longitudinal sliding relative thereto;

extension control cable means connected between said truck means and said ladder and operative to slidably extend and retract said ladder with respect to said slider and to provide for free retraction of said ladder;

retraction means connected between said truck means and said slider for pivoting said slider between its operative and inoperative position; and an access walkway leading longitudinally from said truck along said projection to said slide and opening adjacent thereto for access to said ladder by workmen when it is vertically disposed in its operative position whereby said truck may convey said ladder to the edge of said dock, said retraction means operated to pivot said slide to its operative position overhanging said barge and said extension control means operated to slide said ladder downwardly into said barge so workmen can walk along said walkway to said ladder to descend down said ladder.

2. A ladder carriage apparatus according to claim 1 wherein:

said truck means includes a pair of supporting wheels and said overhang projects in one direction beyond said wheels, said truck means including:

counterbalance means disposed on the side of said wheels opposite said overhang.

3. A ladder carriage apparatus according to claim 1 wherein:

said extension means includes a winch mounted on said truck means and a cable leading to and connected with said ladder.

4. A ladder carriage apparatus according to claim 1 wherein:

said retraction means includes jack means connected between said truck means and slide.

5. A ladder carriage apparatus according to claim 1 that includes:

a retainer mounted on said truck for receipt of one extremity of said ladder when it is in its retracted position.

6. A ladder carriage apparatus according to claim 1 that includes:

a hand railing extending along said walkway.

* * * * *